US008581788B2

(12) United States Patent
Degner et al.

(10) Patent No.: US 8,581,788 B2
(45) Date of Patent: Nov. 12, 2013

(54) ANTENNAS FOR ELECTRONIC DEVICES

(75) Inventors: Brett William Degner, Menlo Park, CA (US); Matthew Ian McDonald, San Jose, CA (US)

(73) Assignee: Apple Inc., Cupertino, CA (US)

( * ) Notice: Subject to any disclaimer, the term of this patent is extended or adjusted under 35 U.S.C. 154(b) by 84 days.

(21) Appl. No.: 13/051,905

(22) Filed: Mar. 18, 2011

(65) Prior Publication Data

US 2011/0169700 A1 Jul. 14, 2011

Related U.S. Application Data

(62) Division of application No. 12/061,194, filed on Apr. 2, 2008, now Pat. No. 7,911,397.

(51) Int. Cl.
*H01Q 1/24* (2006.01)

(52) U.S. Cl.
USPC ..... 343/702; 343/882; 343/906

(58) Field of Classification Search
USPC ..... 343/702, 882, 906
See application file for complete search history.

(56) References Cited

U.S. PATENT DOCUMENTS

| | | | | |
|---|---|---|---|---|
| 5,913,174 | A | 6/1999 | Casarez et al. | |
| 5,983,119 | A | 11/1999 | Martin et al. | |
| 6,208,874 | B1 | 3/2001 | Rudsill et al. | |
| 6,232,924 | B1 | 5/2001 | Winstead et al. | |
| 6,259,409 | B1 | 7/2001 | Fulton et al. | |
| 6,266,017 | B1 * | 7/2001 | Aldous | 343/702 |
| 6,272,356 | B1 | 8/2001 | Dolman et al. | |
| 6,317,085 | B1 | 11/2001 | Sandhu et al. | |
| 6,359,591 | B1 * | 3/2002 | Mou | 343/702 |
| 6,377,218 | B1 * | 4/2002 | Nelson et al. | 343/702 |
| 7,050,008 | B2 | 5/2006 | Saito et al. | |
| 7,429,956 | B2 * | 9/2008 | Park et al. | 343/702 |
| 7,567,217 | B1 | 7/2009 | Chen | |
| 7,579,993 | B2 * | 8/2009 | Lev et al. | 343/702 |
| 8,138,978 | B1 * | 3/2012 | Vier et al. | 343/702 |
| 2002/0021252 | A1 * | 2/2002 | Schremmer et al. | 343/702 |
| 2004/0140937 | A1 * | 7/2004 | Yang | 343/702 |
| 2005/0093762 | A1 | 5/2005 | Pick | |

* cited by examiner

*Primary Examiner* — Tho G Phan
(74) *Attorney, Agent, or Firm* — Treyz Law Group; David C. Kellogg

(57) ABSTRACT

A removable antenna and a resilient antenna are provided for an electronic device such as a laptop computer. An antenna resonating element is mounted within the antenna. Flexible coupling structures are used to physically and removably attach the antenna to the electronic device. The flexible coupling structures couple the antenna resonating element to circuitry in the electronic device. The coupling structures may allow the antenna to break away from the electronic device without causing damage. A user may extend the antenna by rotating the removable antenna to its extended position. The electronic device may have an antenna receptacle that holds the resilient antenna in a stowed position and that allows the resilient antenna to flex to an extended position. A user may extend the resilient antenna by removing the resilient antenna from the antenna receptacle and flexing the antenna into its extended position.

11 Claims, 17 Drawing Sheets

ANTENNAS FOR ELECTRONIC DEVICES

This application is a division of patent application Ser. No. 12/061,194, filed Apr. 2, 2008, now U.S. Pat. No. 7,911,397 which is hereby incorporated by reference herein in its entirety.

BACKGROUND

This invention relates to antennas, and more particularly, to removable antennas and resilient antennas for electronic devices.

It may be desirable to include wireless communications capabilities in an electronic device. Electronic devices may use wireless communications to communicate with wireless base stations. For example, electronic devices may communicate using the Wi-Fi® (IEEE 802.11) bands at 2.4 GHz and 5.0 GHz and the Bluetooth® band at 2.4 GHz. Electronic devices may also use other types of communications links. For example, electronic devices such as cellular telephones may communicate using cellular telephone bands at 850 MHz, 900 MHz, 1800 MHz, and 1900 MHz (e.g., the main Global System for Mobile Communications or GSM cellular telephone bands). Communications are also possible in data service bands such as the 3G data communications band at 2100 MHz (commonly referred to as UMTS or Universal Mobile Telecommunications System).

Many popular housing materials for electronic devices such as metal have a high conductivity. This poses challenges when designing an antenna for an electronic device with this type of housing. An internal antenna would be shielded by a high-conductivity housing, so internal antenna designs are often not considered practical in electronic devices with conductive cases. On the other hand, external antenna designs that permanently protrude from a device's housing may have an unattractive appearance. Conventional protruding antenna designs may also be susceptible to damage.

It would therefore be desirable to be able to provide improved antennas for electronic devices.

SUMMARY

In accordance with an embodiment of the present invention, removable antennas and resilient antennas for electronic devices are provided. A removable antenna may be removably coupled to an electronic device. A removable antenna may also be referred to as a break-away antenna. The antenna and the electronic device may have corresponding coupling structures. The coupling structures may be flexible and may removably couple the antenna to the electronic device. Flexible coupling structures may be integrated into the structure of the antenna and the structure of the electronic device. With one suitable arrangement, the coupling structures may be formed in distinct portions of the antenna and the electronic device. At least one of the coupling structures maybe formed from a flexible material that is not permanently deformed when bent (i.e., an elastic material). Because the antenna is removably coupled to the electronic device with flexible elastic coupling structures, the antenna may be removed from the electronic device without damaging the antenna, the electronic device, or the flexible coupling structures. This helps to prevent damage in the event that the antenna is accidently dislodged from the electronic device.

If desired, the antenna may be extendable. The electronic device may have a conductive housing. The antenna may exhibit improved transmission and reception efficiencies when the antenna is placed in an extended position away from the conductive housing. In the antenna's extended position, the antenna's performance may be enhanced by the increase in separation (e.g., compared to a stowed position) between an antenna resonating element in the antenna and the ground plane of the metal housing of the electronic device. The antenna resonating element in the antenna may be formed using any suitable antenna design. For example, the antenna resonating element may be formed from a flex circuit containing a strip of conductor, a piece of stamped metal foil, a length of wire, etc.

In addition to physically coupling the antenna and the electronic device together, the coupling structures may electrically couple the antenna resonating element structures in the antenna to a transceiver in the electronic device through a communications path. The coupling structures may allow the antenna resonating element to be electrically coupled to and decoupled from the communications path without damaging the coupling structures.

The coupling structures may be conductive. Conductive coupling structures may be used to electrically connect the communications path and the antenna resonating element while physically coupling the antenna to the electronic device using the elastic properties of the coupling structures.

A removable and extendable antenna may be configured to extend by rotating about an axis. For example, an antenna may be extended by rotating the antenna about an axis centered near one of the ends of the antenna.

The coupling structures may provide feedback to a user of the electronic device when the antenna is in its extended or its stowed position and when the antenna is coupled to or decoupled from the electronic device. For example, the coupling structures may be configured to make a noise when the antenna enters its extended or its stowed position or may be configured make a noise when the antenna is coupled to or decoupled from the electronic device.

A removable and extendable antenna may be configured to blend in with surrounding portions of an electronic device when the antenna is in a stowed position. For example, the antenna may have an outer surface that is appropriately colored, textured, and shaped such that the antenna in its stowed position appears as a nearly seamless or unobtrusive portion of the electronic device. Magnetic coupling structures may produce a magnetic force that aligns the antenna with the electronic device in its stowed state such that the antenna properly blends in with the surrounding portions of the electronic device.

In accordance with an embodiment of the present invention, resilient antennas are provided that may be non-removable. The resilient antenna may be physically and electrically coupled to an electronic device. The electronic device may have an antenna receptacle that holds the resilient antenna. The resilient antenna may be elastic and may be configured so that the antenna can be stowed by elastically bending or flexing the resilient antenna into the antenna receptacle in the electronic device. The antenna receptacle may have tabs that hold the resilient antenna in its stowed position. The antenna receptacle may allow a user to stow or extend the resilient antenna by flexing the antenna around the tabs in the antenna receptacle. The resilient antenna may be formed from a super-elastic material such as Nitinol®.

Further features of the invention, its nature and various advantages will be more apparent from the accompanying drawings and the following detailed description.

DETAILED DESCRIPTION

The present invention relates generally to antennas, and more particularly, to extendable, removable antennas and resilient antennas for wireless electronic devices.

The wireless electronic devices may be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. With one suitable arrangement, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
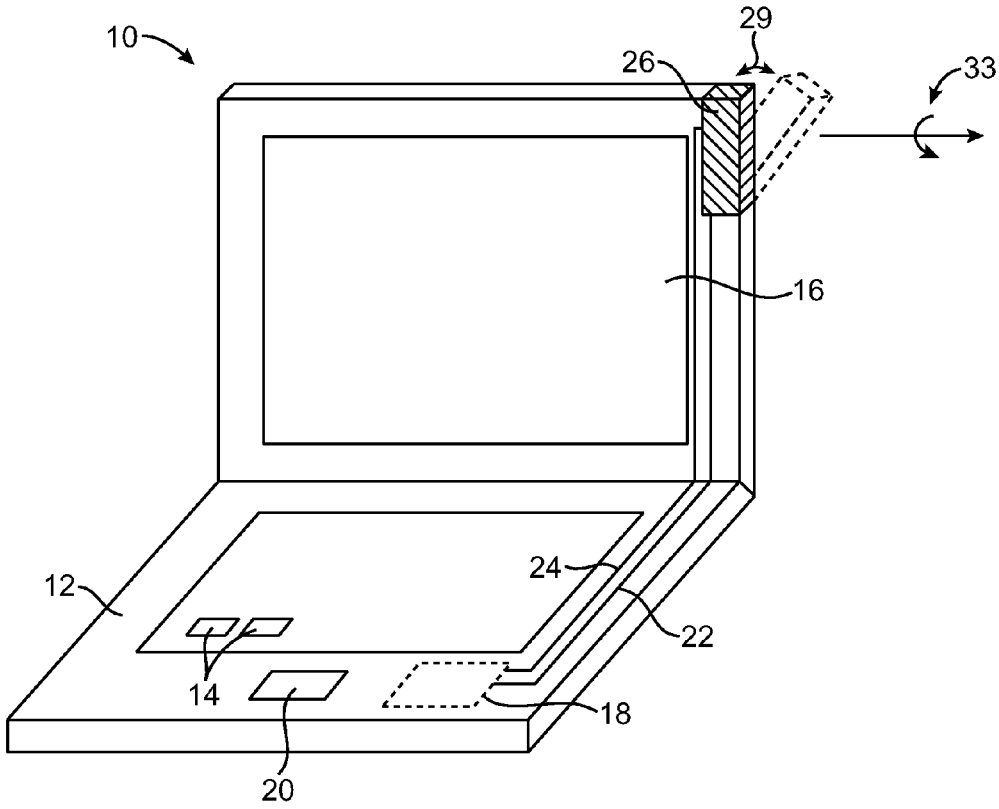
FIG. 1 is a perspective view of an illustrative electronic device and an illustrative extendable, removable antenna in a stowed state in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3G data bands (e.g., the UMTS band at 1920-2170). These bands may be covered by using single band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz).

Device 10 may have housing 12. Housing 12, which is sometimes referred to as a case, may be formed of any suitable materials including plastic, glass, ceramics, metal, other suitable materials, or a combinations of these materials.

Housing 12 or portions of housing 12 may also be formed from conductive materials such as metal. An illustrative metal housing material that may be used is anodized aluminum. Aluminum is relatively light in weight and, when anodized, has an attractive insulating and scratch-resistance surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printer circuit board structure used in forming antenna structures for device 10).

Device 10 may have one or more buttons such as buttons 14. Buttons 14 may be formed on any suitable surface of device 10. In the example of FIG. 1, buttons 14 have been formed on the top surface of device 10. As an example, buttons 14 may form a keyboard on a laptop computer.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 20. An advantage of integrating a touch screen into display 16 to make display 16 touch-sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Communications paths such as coaxial communications paths and microstrip communications paths may be used to convey radio-frequency signals between transceiver circuitry and antenna structures in device 10. As shown in FIG. 1, for example, communications path 22 may be used to convey signals between antenna structure 26 and circuitry 18. Communications path 22 may be, for example, a coaxial cable that is connected between an RF transceiver (sometimes called a radio) and a multiband antenna. Antenna structures such as antenna structure 26 may be located adjacent to a corner of device 10 as shown in FIG. 1 or in other suitable locations. For example, antenna structure 26 may be located along a top edge of display 16, along any edge of device 10, or may be located in a suitable portion of any planar surface of device 10.

Antenna structure 26 may be removable and extendable. Antenna structure 26 may be physically but removably coupled to device 10 to allow the antenna structure to be removed without damaging antenna structure 26 or device 10. The coupling of antenna structure 26 to device 10 may facilitate easy replacement of antenna structure 26 and may facilitate break away of the antenna structure when a force is applied that could otherwise damage the antenna structure.

Antenna structure 26 may rotate from a stowed position (e.g., the position shown in FIG. 1) into an extended position and vice-versa (e.g., as indicated by line 29 and the dotted outline of antenna structure 26). The extended position of antenna structure 26 may be used to increase the efficiency of signal reception and transmission. For example, the extended position of antenna structure 26 may enhance wireless communications functionality by increasing the separation between the ground plane of device 10 and antenna resonating elements in antenna structure 26 relative to the separation between the ground plane and the antenna resonating elements when antenna structure 26 is in the stowed position.

Antenna structure 26 may be configured such that in the stowed position the antenna structure is flush, or nearly flush, with the surrounding portions of device 10. The stowed position of the antenna structure may improve the visual appearance of device 10. For example, when the antenna structure is in the stowed position, the antenna structure may blend in with the surrounding portions of device 10 and thereby reduce visual clutter. In the stowed position, the antenna structure is also generally less vulnerable to accidental detachment.

As illustrated in FIG. 1, antenna structure 26 may rotate about an axis such as axis 33. Antenna structure 26 may rotate about axis 33 when transitioning between its stowed state and its extended state.

Device 10 may have sensors to determine whether antenna structure 26 is attached or detached and to determine whether antenna structure 26 is in an extended or stowed position. Communications path 24 may be used to convey signals between these sensors and circuitry 18. Communications path 24 may be implemented using any suitable cable or wires.

Figure 2:
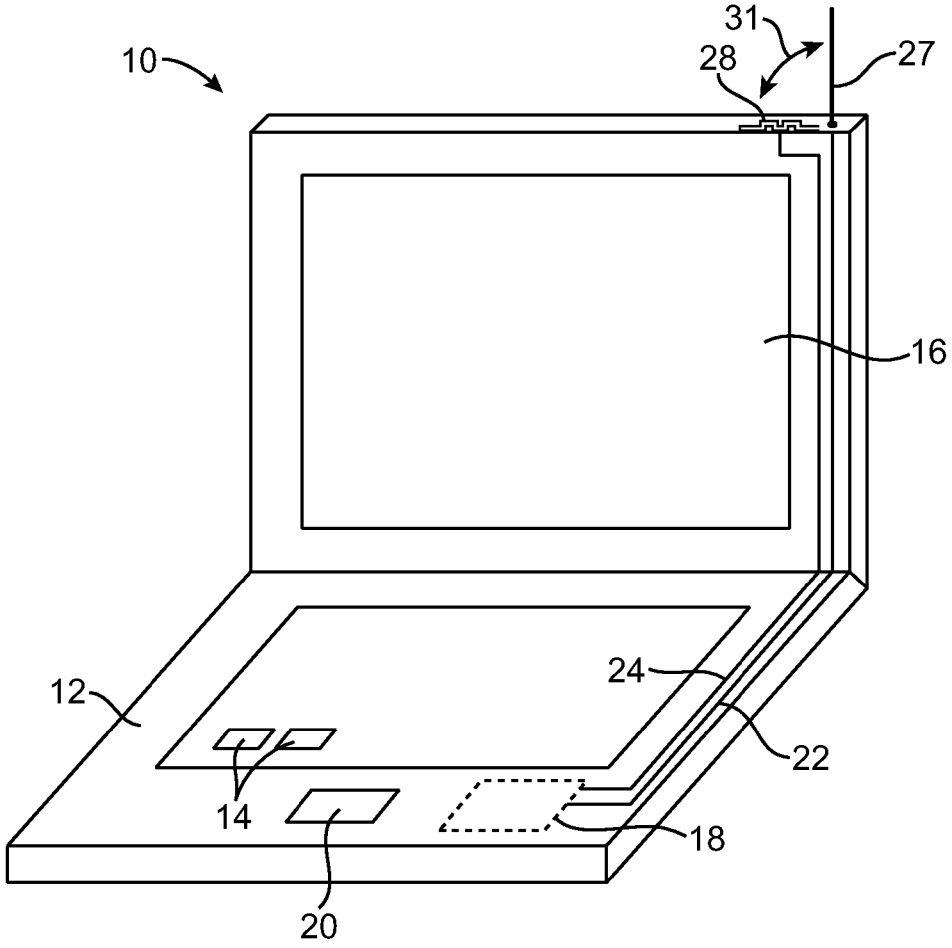
FIG. 2 is a perspective view of an illustrative electronic device and an illustrative resilient antenna in an extended state in accordance with an embodiment of the present invention.

As shown in FIG. 2, device 10 may have a resilient antenna structure that is flexible and extendable such as antenna structure 27. Antenna structure 27 may be formed from an elastic material that has an original shape such as the shape shown in FIG. 2. Antenna structure 27 may be formed from a material that is capable of returning to its original shape (e.g., the shape shown in FIG. 2) even after potentially extensive stress or deformation. For example, antenna structure 27 may be formed from a shape memory alloy, a suitably elastic material, a superelastic material such as a nickel-titanium alloy (e.g., Nitinol®), or any other suitable material. A superelastic material may be any material which only deforms elastically and not plastically during the range of deformations that antenna structure 27 may encounter. Antenna structure 27 may be made of a material that deforms elastically and not plastically while the antenna structure is flexed or bent (e.g., the deformation of antenna structure 27 is reversible).

Antenna structure 27 may be mounted on device 10 at any suitable attachment point. For example, antenna structure 27 may be attached to the top or side edge of device 10. Antenna structure 27 may be stowed by bending the antenna structure 27 along line 31 into an antenna receptacle in device 10 such as antenna receptacle 28. Antenna structure 27 may be extended from removing the antenna structure from antenna receptacle 28 and allowing the antenna structure to elastically return to its natural position (e.g., the position of FIG. 2).

Advantages of utilizing a resilient antenna structure such as antenna structure 27 in device 10 may include a simplified design of device 10 and a more efficient utilization of available space in device 10 (e.g., relative to a design of device 10 utilizing a removable antenna structure). For example, the mechanical and electrical connection between device 10 and antenna structure 27 may not require moving parts that could add to the complexity and cost of device 10. Antenna structure 27 may also, as an example, be formed from a single flexible wire that may be significantly smaller (e.g., take up less space in device 10) than a removable antenna structure such as antenna structure 26).

Figure 3:
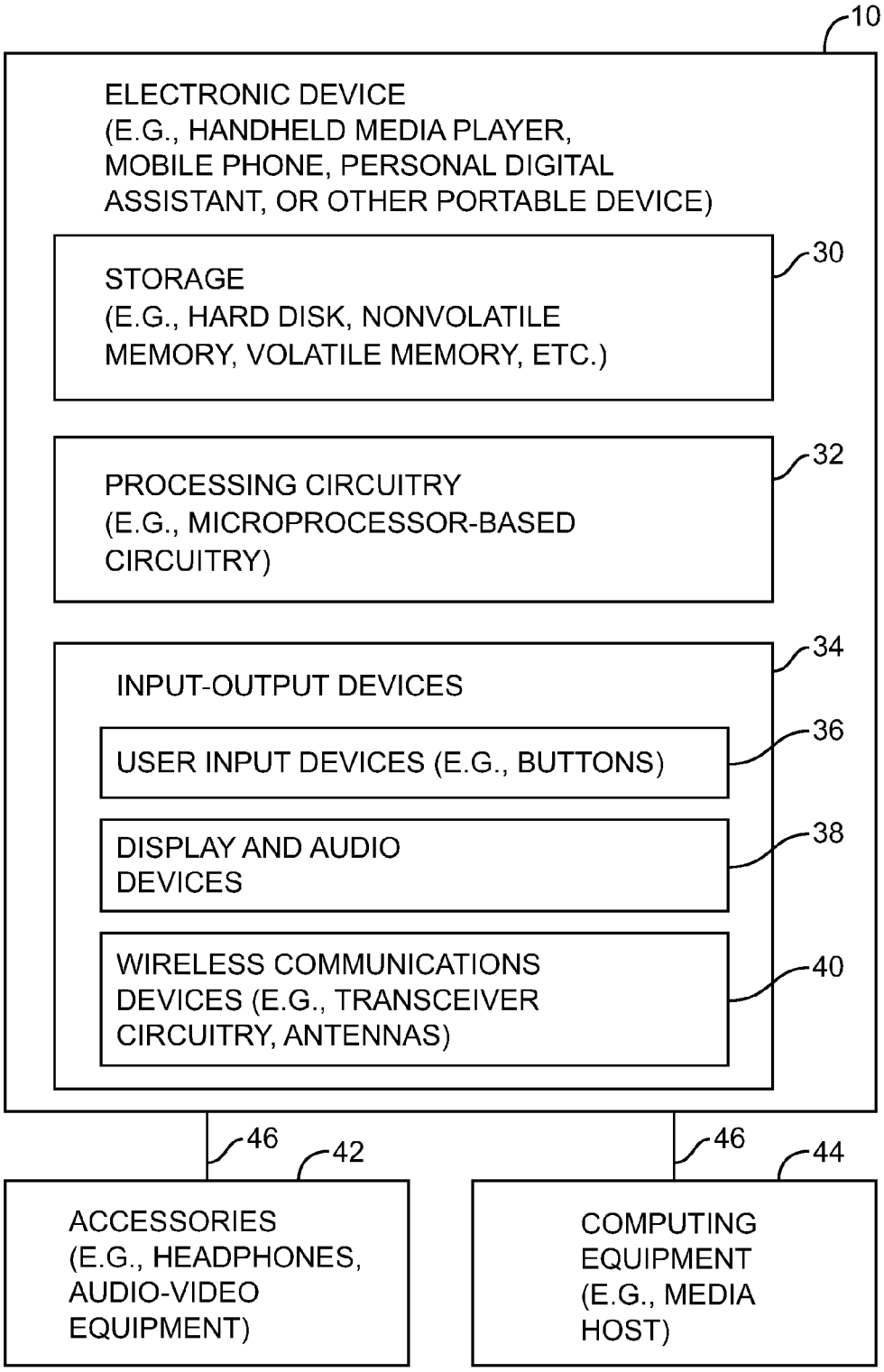
FIG. 3 is a schematic diagram of an illustrative electronic device in accordance with an embodiment of the present invention.

A schematic diagram of an embodiment of electronic device 10 is shown in FIG. 3. Electronic device 10 may be a notebook computer, a tablet computer, an ultraportable computer, a mobile telephone, a mobile telephone with media player capabilities, a handheld computer, a remote control, a game player, a global positioning system (GPS) device, a combination of such devices, or any other suitable portable or handheld electronic device.

As shown in FIG. 3, electronic device 10 may include storage 30. Storage 30 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 32 may be used to control the operation of device 10. Processing circuitry 32 may be based on a processor such as a microprocessor and other suitable integrated circuits. With one suitable arrangement, processing circuitry 32 and storage 30 are used to run software on device 10, such as internet browsing applications, voice-over-internet-protocol (VOIP) telephone call applications, email applications, media playback applications, operating system functions, etc. Processing circuitry 32 and storage 30 may be used in implementing suitable communications protocols. Communications protocols that may be implemented using processing circuitry 32 and storage 30 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 34 may be used to allow data to be supplied to device 10 and to allow data to be provided from device 10 to external devices. Display screen 16, keys 14, and touchpad 20 of FIG. 1 are examples of input-output devices 34.

Input-output devices 34 may include user input-output devices 36 such as buttons, touch screens, joysticks, click wheels, scrolling wheels, touch pads, key pads, keyboards, microphones, cameras, speakers, tone generators, vibrating elements, etc. A user can control the operation of device 10 by supplying commands though user input devices 36.

Display and audio devices 38 may include liquid-crystal display (LCD) screens or other screens, light-emitting diodes (LEDs), and other components that present visual information and status data. Display and audio devices 38 may also include audio equipment such as speakers and other devices for creating sound. Display and audio devices 38 may contain audio-video interface equipment such as jacks and other connectors for external headphones and monitors.

Wireless communications devices 40 may include communications circuitry such as radio-frequency (RF) transceiver circuitry formed from one or more integrated circuits, power amplifier circuitry, passive RF components, one or more antennas (e.g., antenna structures such as antenna structure 26 of FIG. 1), and other and other circuitry for handling RF wireless signals. Wireless signals can also be sent using light (e.g., using infrared communications).

Device 10 can communicate with external devices such as accessories 42 and computing equipment 44, as shown by paths 46. Paths 46 may include wired and wireless paths. Accessories 42 may include headphones (e.g., a wireless cellular headset or audio headphones) and audio-video equipment (e.g., wireless speakers, a game controller, or other equipment that receives and plays audio and video content).

Computing equipment 44 may be any suitable computer. With one suitable arrangement, computing equipment 44 is a computer that has an associated wireless access point or an internal or external wireless card that establishes a wireless connection with device 10. The computer may be a server (e.g., an internet server), a local area network computer with or without internet access, a user's own personal computer, a peer device (e.g., another electronic device 10), or any other suitable computing equipment.

The antenna structures and wireless communications devices of device 10 may support communications over any suitable wireless communications bands. For example, wireless communications devices 40 may be used to cover communications frequency bands such as the cellular telephone bands at 850 MHz, 900 MHz, 1800 MHz, and 1900 MHz, data service bands such as the 3G data communications band at 2100 MHz (commonly referred to as UMTS or Universal Mobile Telecommunications System), Wi-Fi® (IEEE 802.11) bands at frequencies such as 2.4 GHz and 5.0 GHz (also sometimes referred to as wireless local area network or WLAN bands), the Bluetooth® band at 2.4 GHz, and the global positioning system (GPS) band at 1575 MHz. Device 10 can cover these communications bands and/or other suitable communications bands with proper configuration of the antenna structures in wireless communications circuitry 40).

Figure 4:
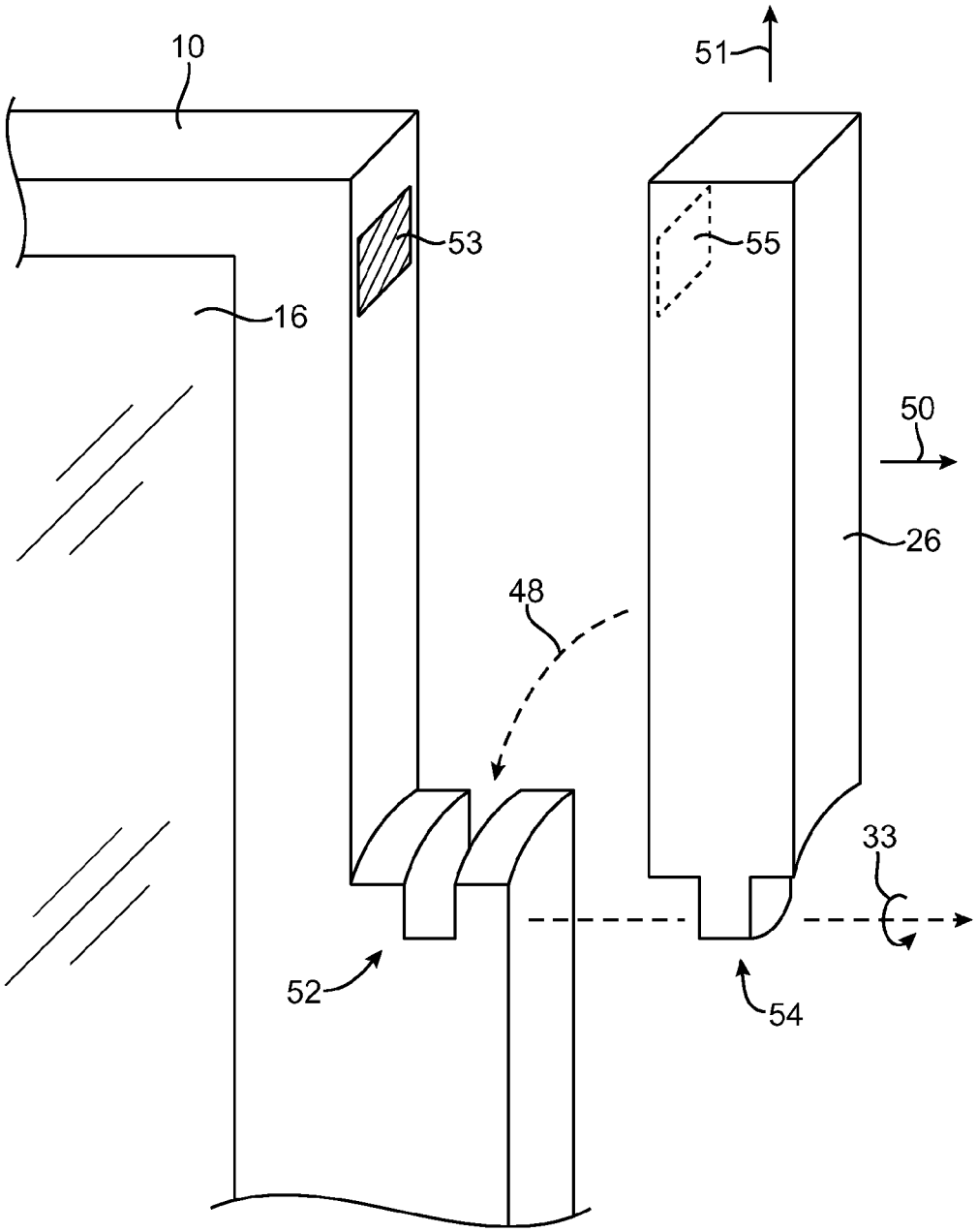
FIG. 4 is an exploded perspective view of a portion of an illustrative electronic device and an illustrative extendable, removable antenna in accordance with an embodiment of the present invention.

As shown in FIG. 4, device 10 may have an extendable, removable antenna structure such as antenna structure 26. Antenna structure 26 may be physically but removably coupled to device 10 to allow the antenna structure to be intentionally or accidentally removed without damaging antenna structure 26 or device 10.

In the FIG. 4 example, antenna structure 26 is shown near device 10 in approximately its stowed and coupled state. If the antenna structure were to be moved in the direction of arrow 48, the antenna structure would be in the approximate position of its stowed and coupled state.

Antenna structure 26 may be extended from a stowed position that may enhance the aesthetics of device 10 to an extended position that may enhance the performance and efficiency of the antenna structure by rotating about a rotational axis such as the axis of line 33 (e.g., the axis of coupling between structure 26 and device 10). Physical coupling may be used to hold antenna structure 26 in place on device 10 during rotational movement (e.g., to limit non-rotational movement between structure 26 and device 10). The antenna structure may be configured to blend in with surrounding portions of device 10 when the antenna structure is it its stowed position. For example, antenna structure 26 may have an outer surface that is appropriately colored, textured, and shaped such that the antenna structure in its stowed position appears as a nearly seamless or unobtrusive portion of device 10.

Antenna structure 26 may be configured to break away from device 10 to prevent damage to the antenna structure and device 10. For example, if antenna structure 26 rotates too far around axis 33, antenna structure 26 may break away from device 10. Antenna structure 26 may also break away when a force acts upon the antenna structure to either push or pull the antenna structure away from device 10. For example, if the antenna structure is struck in direction 50 or direction 51, the physical coupling between device 10 and antenna structure 26 may give way before damage occurs to the antenna structure, the device, or the coupling structures in the antenna structure and the device.

Antenna structure 26 may be mechanically and electrically coupled to device 10 using coupling structures such as coupling structure 52 on device 10 and a corresponding coupling structure on antenna structure 26 such as coupling structure 54. Coupling structure 52 and a corresponding coupling structure in antenna structure 26 such as coupling structure 54 may be used to couple communications path 22 to an antenna resonating element in antenna structure 26.

Coupling structures 52 and 54 may be configured to allow antenna structure 26 to rotate about an axis such as axis 33. Antenna structure 26 may rotate about axis 33 when rotating from a stowed position into an extended position or when rotating from an extended position into the stowed position. Coupling structures 52 and 54 may be configured to couple antenna structure 26 to device 10 in such a way as the antenna structure is not released during normal operations (e.g., while rotating antenna structure 26 around axis 33) but so that the antenna structure may break away from device 10 during abnormal operations (e.g., when the antenna structure is pulled from device 10 or is rotated too far around axis 33).

Coupling structures 52 and 54 may be configured to provide feedback to a user when the antenna structure is coupled or decoupled or when the antenna structure is in its extended or its stowed position. For example, the coupling structures may be configured to make a noise when the antenna structure enters its extended or its stowed position. The coupling structures may be configured to make a noise when the antenna structure is coupled to or decoupled from device 10.

Magnetic coupling structure 53 on device 10 and corresponding magnetic coupling structure 55 on antenna structure 26 may provide a magnetic attraction force between the device and the antenna structure when the antenna structure is in its stowed position. The magnetic attraction force provided by coupling structures 53 and 55 may hold the antenna structure in its stowed position. Coupling structures 53 and 55 (or portions of the coupling structures) may be made of one or more magnetic elements (magnets) and/or one or more ferromagnetic elements (e.g., iron bars).

Magnetic or ferromagnetic portions of the coupling structures may produce a magnetic force that holds antenna structure 26 to device 10 in the antenna structure's stowed position. The magnetic coupling structures may contribute to a magnetic force that aligns the antenna structure with device 10 in its stowed position such that the antenna structure properly blends in with the surrounding portions of device 10.

Figure 5A:
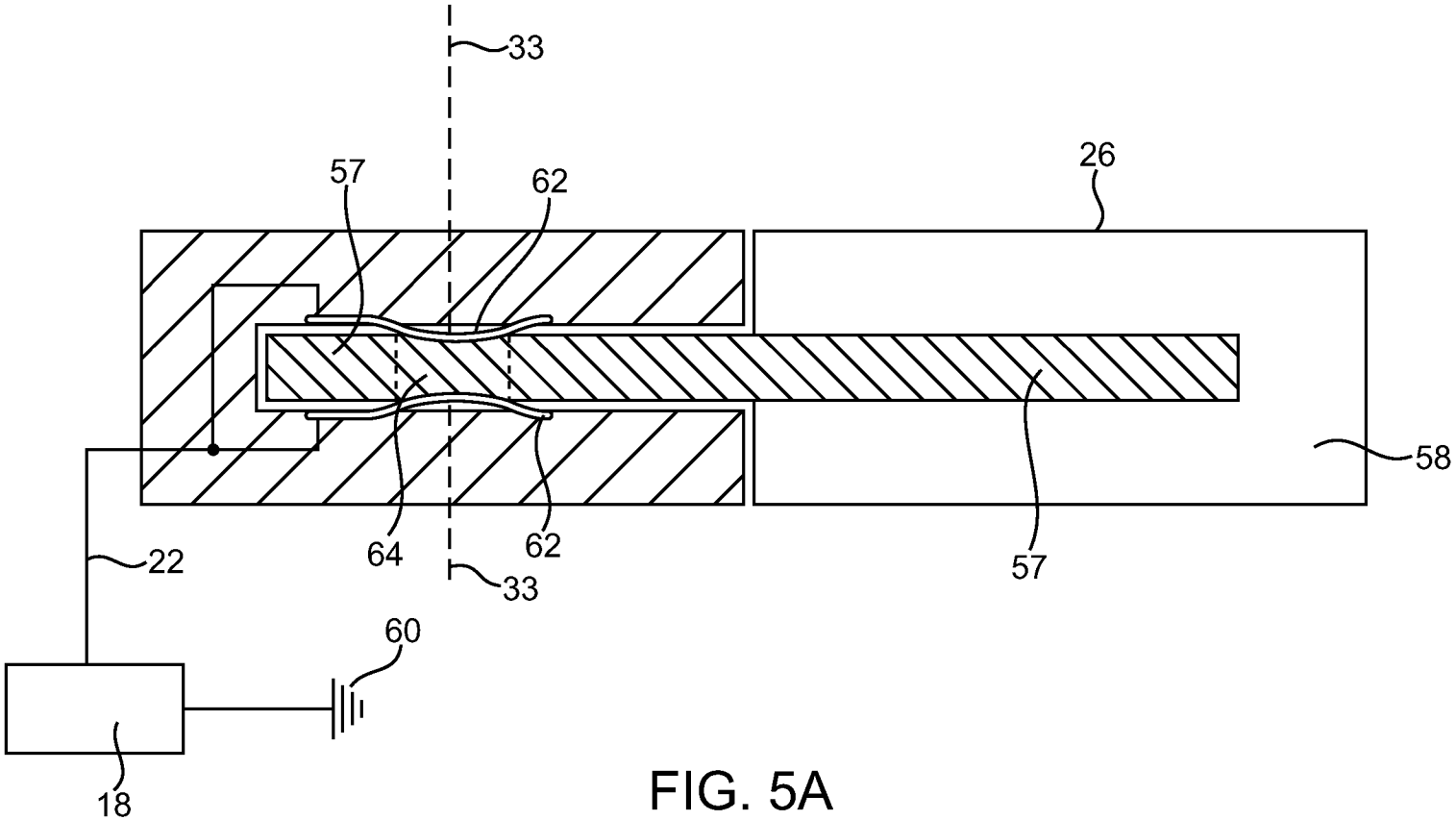
FIG. 5A is a cross-sectional view of an illustrative antenna coupling structure in an electronic device and an illustrative extendable, removable antenna in a coupled state in accordance with an embodiment of the present invention.

As shown in FIG. 5A, antenna structure 26 may have an antenna resonating element such as antenna resonating element 57 and an overmold portion such as overmold 58. Antenna resonating element 57 may be formed from any suitable antenna resonating element structure. For example, the antenna resonating element may be formed from a flex circuit containing a strip of conductor, a piece of stamped metal foil, a length of wire, etc. Overmold 58 may be formed of any suitable material such as plastic. Overmold 58 may be flexible and may serve to protect antenna resonating element 57 from damage. Overmold 58 may enhance the visual appearance of antenna structure 26 and may provide antenna structure 26 with structural integrity.

Circuitry 18 (e.g., a radio-frequency transceiver in device 10) may be electrically coupled to antenna resonating element 57 in antenna structure 26 through communications path 22 and coupling structures 62 and 64. For example, circuitry 18 may be electrically coupled to element 57 through physical contact between coupling structures such as structures 62 and 64. With another suitable arrangement, circuitry 18 may be electrically coupled to element 57 when coupling structures such as structures 62 and 64 are in close proximity. This kind of arrangement may be referred to as capacitive coupled (e.g., capacitive coupling between structures 62 and 64). Circuitry 18 may transmit and receive radio-frequency signals using antenna resonating element 57 as one pole of an antenna. Circuitry 18 may utilize a separate ground plane for the antenna by grounding to a metal structure such as housing 12 (e.g., as shown by ground symbol 60). Coupling structures 62 and 64 may be configured to maintain the electrical coupling between antenna resonating element 57 and communications path 22 as antenna structure 26 rotates between its extended and stowed positions (e.g., as antenna structure 26 rotates around axis 33 of FIG. 4).

In the FIG. 5A example, antenna structure 26 is illustrated in its stowed and coupled position and coupling structures 62 are mated with corresponding coupling structure 64 in the antenna structure. Antenna structure 26 may rotate from the illustrated stowed position into an extended position (e.g., into or out of the plane of FIG. 5A) by rotating about an axis centered on coupling structure 64 and structures 62 (e.g., axis 33).

Device 10 (e.g., the coupling structure in device 10) may have protrusions or wall structures that act to limit non-rotational movement of antenna structure 26. A portion of antenna structure 26 may fit in between the wall structures of device 10. The portion of antenna structure 26 that fits in between the wall structures of device 10 may be formed from elastic materials that enhance the ability of the antenna structure to break away from the electronic device.

The coupling structures of the FIG. 5A example are merely illustrative examples of coupling structures and any suitable coupling structure may be used (e.g., such as the types shown in FIGS. 6-10). Coupling structures 62 and 64 may be electrically conductive or may have an electrically conductive coating in order to provide sufficient electrical coupling between communications path 22 and antenna resonating element 57.

Coupling structures 62 may be formed of an elastic material such as an elastic metal or other suitable material. Elastic properties of coupling structures 62 may facilitate the physical and electrical coupling of antenna structure 26 to device 10 while allowing structure 26 to break-away from device 10 without causing damage to the antenna structure, the device, or the coupling structures. Elastic coupling structures may be configured to flex or bend in the elastic deformation regime while avoiding plastic deformation (e.g., non-reversible deformation). Coupling structure 64 may be formed using a cylindrical hole in antenna structure 26 that coupling structures 62 press into when the antenna structure is in its coupled position. Coupling structures 62 may be configured to flex so that, as antenna structure 26 is removed, coupling structures 62 may flex into a position that allows the antenna structure to be removed from or inserted into its coupled state with device 10.

Figure 5B:
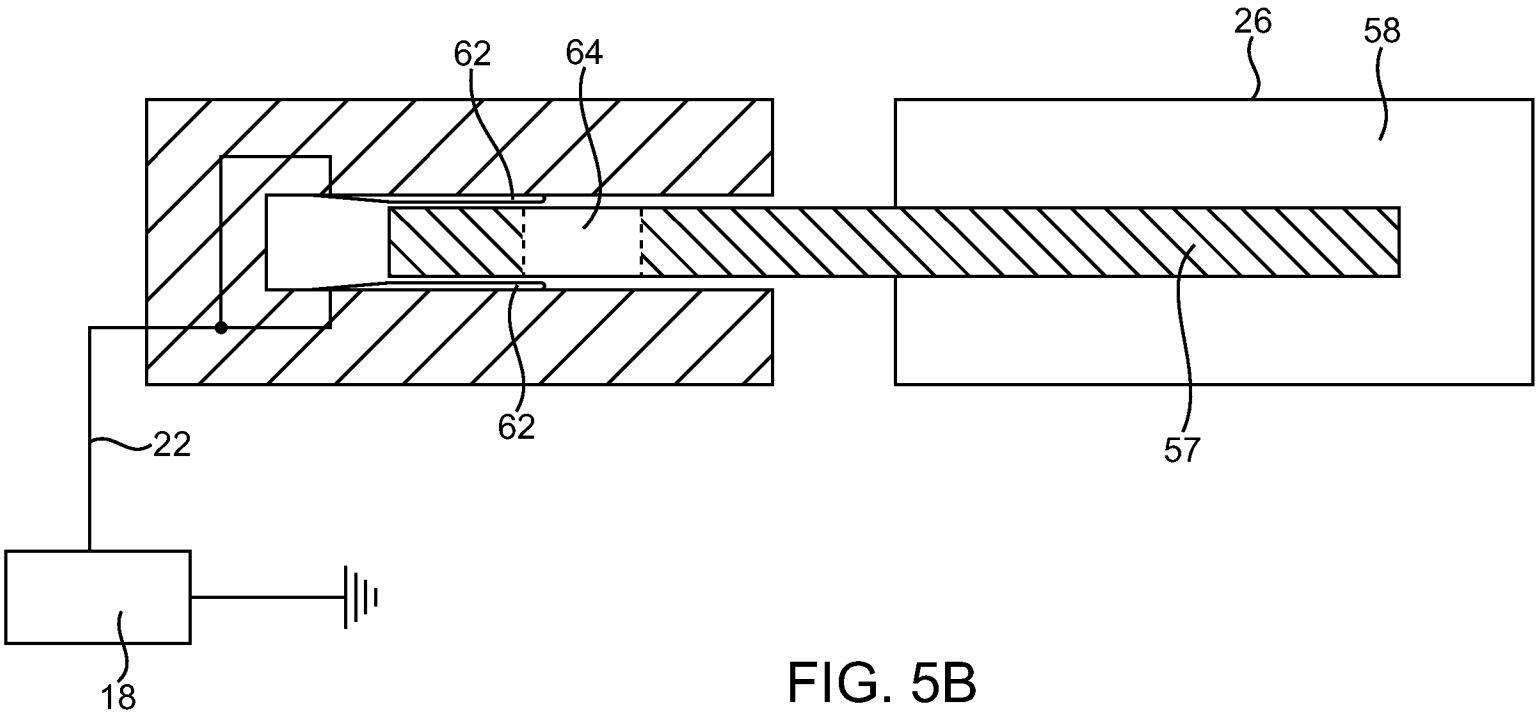
FIG. 5B is a cross-sectional view of the illustrative antenna coupling structure and the illustrative extendable, removable antenna of FIG. 5A in a partially coupled state in accordance with an embodiment of the present invention.

In FIG. 5B, antenna structure 26 of FIG. 5A is shown in a partially removed or partially coupled state. The position of FIG. 5B may occur as the antenna structure is being removed from or attached to device 10. As shown in FIG. 5B, elastic coupling structures 62 may be pressed into a flat configuration by a portion of antenna structure 26 as the antenna structure is removed or inserted.

Figure 5C:
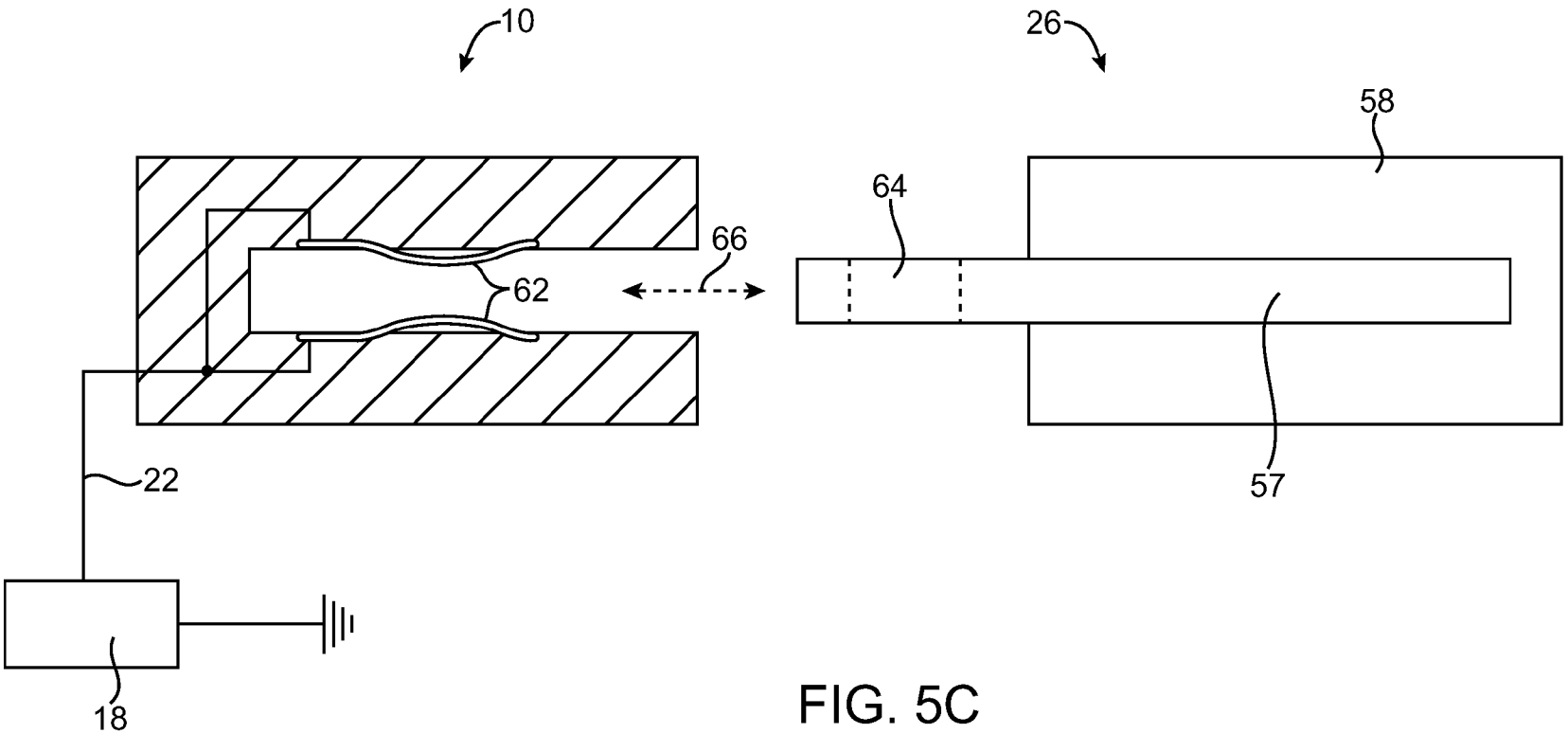
FIG. 5C is a cross-sectional view of the illustrative antenna coupling structure and the illustrative extendable, removable antenna of FIG. 5A in an uncoupled state in accordance with an embodiment of the present invention.

In FIG. 5C, antenna structure 26 of FIG. 5A is shown in a fully removed or uncoupled state. As shown in FIG. 5C, elastic coupling structures 62 may return to their natural positions when antenna structure 26 is removed (e.g., their position when no forces are applied). As shown by line 66, antenna structure 26 may be removed from or inserted into device 10.

Figure 6A:
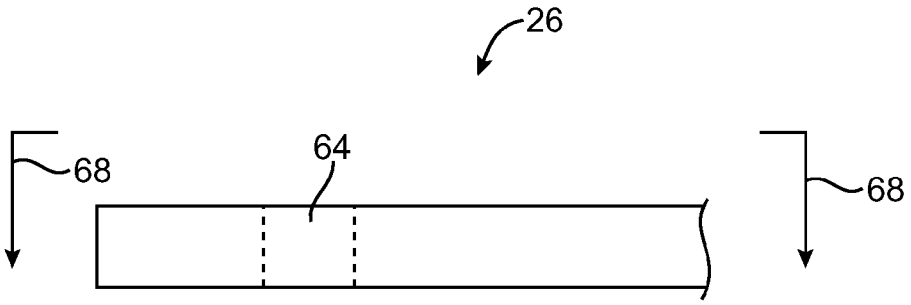
FIG. 6A is a side view of an illustrative extendable, removable antenna in accordance with an embodiment of the present invention.
Figure 6B:
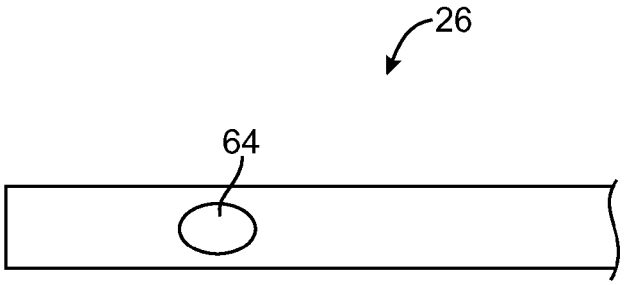
FIG. 6B is a top view of the illustrative extendable, removable antenna of FIG. 6A in accordance with an embodiment of the present invention.

In FIGS. 6A and 6B, two views of coupling structure 64 in antenna structure 26 are shown. Coupling structure 64 may be a cylindrical hole in antenna structure 26. FIG. 6A shows a side view with dotted lines illustrating the bore of the cylindrical hole in antenna structure 26.

FIG. 6B shows a top view of the antenna structure of FIG. 6A (e.g., from the perspective indicated by lines 68). From the perspective of FIG. 6B, the cylindrical hole in antenna structure 26 appears as a circular hole.

Figure 7A:
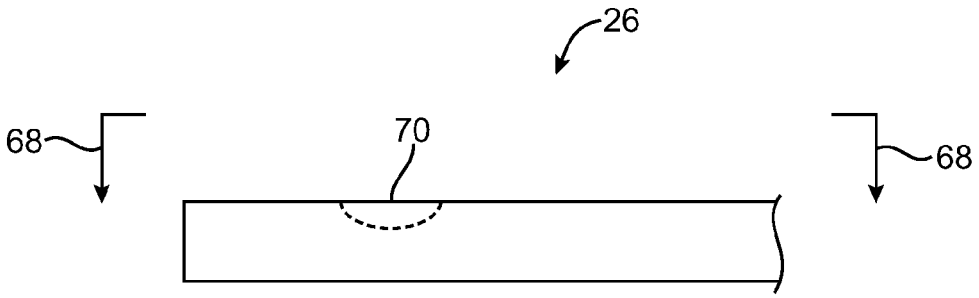
FIG. 7A is a side view of another illustrative extendable, removable antenna in accordance with an embodiment of the present invention.
Figure 7B:
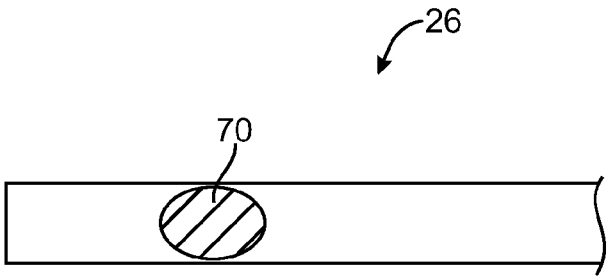
FIG. 7B is a top view of the illustrative extendable, removable antenna of FIG. 7A in accordance with an embodiment of the present invention.

A coupling structure such as coupling structure 70 that may be used in antenna structure 26 is shown in FIGS. 7A and 7B. Coupling structure 70 may be a spherical depression in one side of antenna structure 26. FIG. 7A shows a side view of coupling structure 70 with dotted lines indicating the outline of the spherical depression of coupling structure 70 in antenna structure 26.

FIG. 7B shows a top view of the coupling structure of FIG. 7A from the perspective indicated by lines 68. From the perspective of FIG. 7B, the spherical depression of coupling structure 70 appears as a circular depression (i.e., the deepest portions are in the center of the circular depression).

Figure 8A:
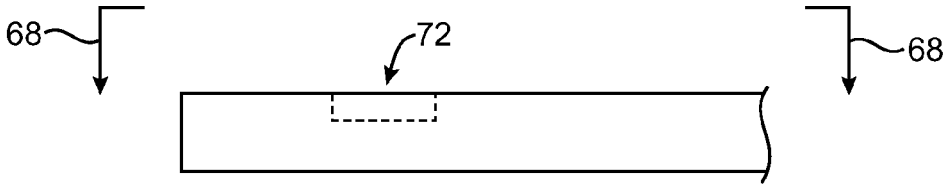
FIG. 8A is a side view of another illustrative extendable, removable antenna in accordance with an embodiment of the present invention.
Figure 8B:
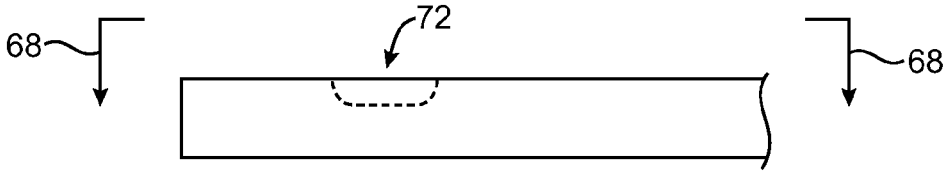
FIG. 8B is a side view of the illustrative extendable, removable antenna of FIG. 8A in accordance with an embodiment of the present invention.
Figure 8C:
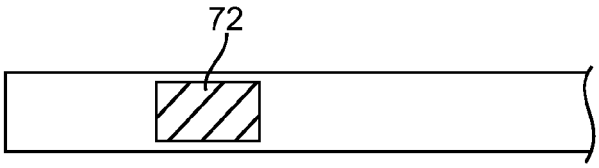
FIG. 8C is a top view of the illustrative extendable, removable antenna of FIG. 8A in accordance with an embodiment of the present invention.

As shown in FIGS. 8A, 8B, and 8C, a rectangular coupling structure such as coupling structure 72 may also be used in antenna structure 26. Coupling structure 72 may be a rectangular depression in one side of antenna structure 26. FIG. 8A shows a side view of coupling structure 70 with dotted lines indicating the outline of the rectangular depression of coupling structure 72.

As shown in FIG. 8B, coupling structure 72 may have rounded edges. Rounded edges of coupling structure 72 may allow antenna structure 26 to be removed or break away with less applied force. For example, rounded edges of structure 72 may reduce the initial force require to remove antenna 26. Rounded edges of structure 72 may also reduce the wear on structures 72 and corresponding coupling structures in antenna 26. For example, the rounded edges of structure 72 may allow the corresponding coupling structure in antenna 26 to slide smoothly into structure 72 without grinding against sharp edges and wearing down either of the coupling structures.

FIG. 8C shows a top view of coupling structure 70 (e.g., the coupling structure of FIG. 8A or 8B) from the perspective indicated by lines 68.

Coupling structure 72 and a corresponding rectangular coupling structure in device 10 may be configured to favor holding the antenna structure in one or more extended positions and a stowed position. Because coupling structure 72 is rectangular, the coupling structure may prefer to align with the corresponding coupling structure in device 10 at certain angles of extension. For example, antenna structure 26 may be configured to favor its stowed position, a fully extended position, and certain partially extended positions. If the fully extended position is defined to be ninety degrees of rotation around axis 33 from the stowed position, antenna structure 26 may be configured to favor zero degrees, ninety degrees, and one hundred and eighty degrees of rotation around axis 33. In embodiments where antenna structure 26 is configured to favor multiple extended positions (i.e., rotational detents), a coupling structure with more than four sides may be used (e.g., a pentagon, hexagon, heptagon, octagon, etc.) Coupling structures with straight edges may limit antenna structure 26 from rotating further around axis 33 when one or more of the straight edges of the coupling structure are aligned.

FIGS. 9A-9J illustrate various coupling structures that may be used in antenna structure 26 (e.g., as a part of coupling structure 54 of FIG. 4) to physically and electrically couple the antenna structure to device 10. The coupling structures of FIGS. 9A-9J may be electrically conductive or may be coated with an electrically conductive coating. The coupling structures of FIGS. 9A-9J that protrude from antenna structure 26 may be made from a flexible material to facilitate the physical and removable coupling of antenna structure 26 with device 10. For example, coupling structures 74 and 80 may be formed from elastic materials.

Figure 9A:
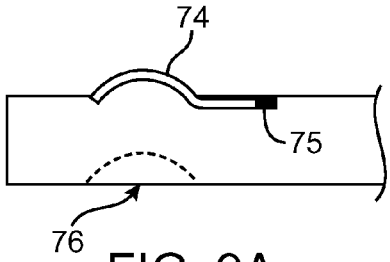
FIGS. 9A, 9B, 9C, 9D, 9E, 9F, 9G, 9H, 9I, and 9J are cross-sectional views of illustrative coupling structures that may be used in an extendable, removable antenna to couple the extendable, removable antenna to an electronic device in accordance with an embodiment of the present invention.
Figure 9B:
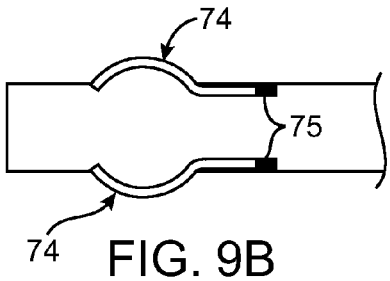
Figure 9C:
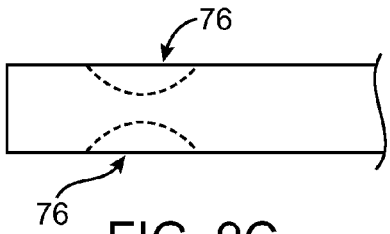
Figure 9D:
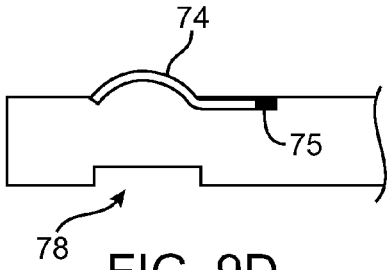

Coupling structure 74, as illustrated in FIGS. 9A, 9B, and 9D, may be a spherical flexure. For example, coupling structure 74 may be formed in a spherical shape with an elastic material. Coupling structure 74 may couple with a corresponding coupling structure in device 10 such as a circular hole or a spherical depression in device 10 (e.g., in coupling structure 52 of FIG. 4). Coupling structure 74 may be secured to antenna structure 26 at location 75 and may be able to flex into or against antenna structure 26. For example, a force applied against coupling structure 74 may press the coupling structure into or flat against antenna structure 26 (e.g., so that the antenna structure may be removed from device 10).

Coupling structures that are described herein as spherical coupling structures (e.g., coupling structures such as coupling structure 62, 70, 74, 76, 86, and 88) may be any suitable portion of a sphere and are not required to be complete spheres. For example, the spherical shape of the coupling structures of the present invention may also be referred to as a spherical cap (e.g., a portion of a sphere cut off by a plane).

With one suitable arrangement, coupling structures including those that are described herein as spherical coupling structures (e.g., structures 62, 70, 74, 76, 86, and 88) may be formed in non-spherical shapes. For example, coupling structures may be formed using splined shapes, parabolic shapes, conical shapes, etc. Splined shapes may be, as an example, similar to deformed spherical shapes (e.g., lopsided spherical shapes).

Coupling structure 80 may be a rectangular flexure. Coupling structure 80 may be formed in a rectangular shape with an elastic material. In another example, coupling structure 80 may be formed in any suitable shape such as a pentagon, hexagon, etc. Coupling structure 80 may couple (e.g., mate) with a corresponding coupling structure in device 10 such as a rectangular hole or depression in device 10. When coupling structure 80 is formed in a shape such as a pentagon, hexagon, etc., the corresponding coupling structure in device 10 may be a hole or depression with the appropriate shape. Coupling structure 80 may be secured to antenna structure 26 at location 75 and may be able to flex into or against antenna structure 26. For example, when antenna structure 26 is removed from device 10, coupling structure 80 may be pressed into or flat against antenna structure 26.

Figure 9E:
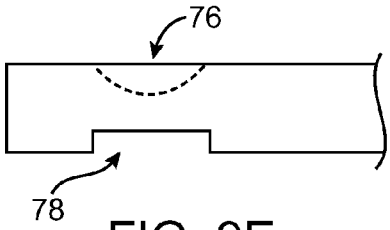

Coupling structure 76, as illustrated in FIGS. 9A, 9C, and 9E, may be a spherical depression in antenna structure 26. Coupling structure 76 may be configured to couple with a corresponding coupling structure in device 10 that may be similar to coupling structure 74.

Figure 9F:
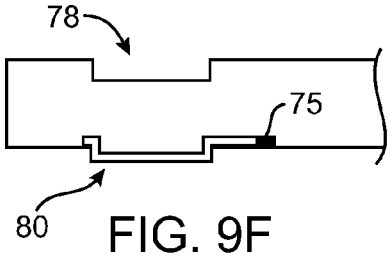
Figure 9G:
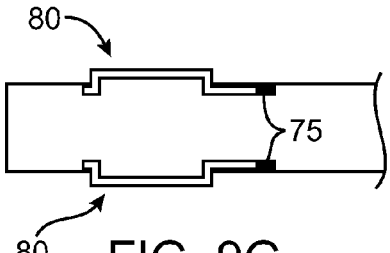

Illustrated by FIGS. 9D, 9E, and 9F, coupling structure 78 may be a rectangular depression in antenna structure 26. Coupling structure 78 may couple with a corresponding coupling structure in device 10 such as a coupling structure similar to coupling structure 80.

Figure 9H:
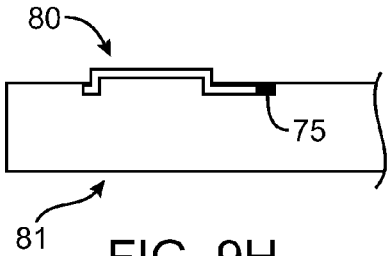

As illustrated by FIG. 9H, antenna structure 26 may be configured with a single coupling structure (e.g., structure 80) and with no coupling structure on the opposing side (e.g., side 81).

Figure 9I:
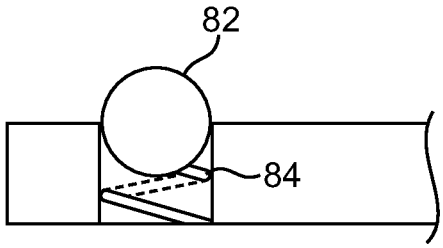
Figure 9J:
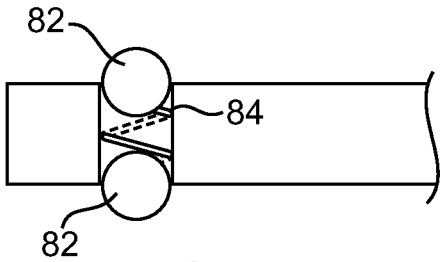

A ball biased by a spring or other biasing member may be used as a coupling structure. As shown in FIG. 9I, ball 82 may be biased by spring 84 and may be used to physically and electrically couple antenna structure 26 to device 10. Ball 82 and/or spring 84 may be electrically conductive or may be coated with an electrically conductive coating. Ball 82 may be biased by spring 84 into a corresponding coupling structure in device 10 when the antenna structure is coupled with the device. For example, ball 82 may be biased into a spherical depression in device 10 such as the depression in coupling structure 86.

In one embodiment, antenna structure 26 may be configured with two balls 82 that are biased by a single spring 84. In another embodiment, the two balls may be biased by separate springs. The two balls may be biased into two corresponding coupling structures (e.g., structures 86 of FIG. 10B) when the antenna structure is coupled with device 10.

FIGS. 10A-10J illustrate various coupling structures that may be used in device 10 (e.g., as a part of coupling structure 52 of FIG. 4) to physically and electrically couple antenna structure 26 to device 10. The coupling structures of FIGS. 10A-10J may be electrically conductive or may be coated with an electrically conductive coating. The coupling structures of FIGS. 10A-10J that protrude from device 10 may be made from a flexible material or an elastic material to facilitate the physical and removable coupling of antenna structure 26 with device 10. For example, coupling structures 88 and 90 may be formed from elastic materials.

Figure 10A:
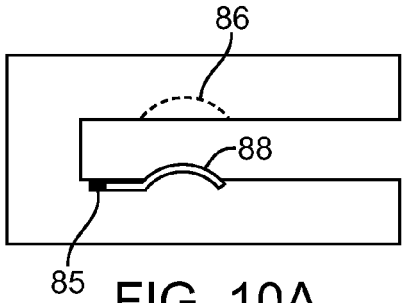
FIGS. 10A, 10B, 10C, 10D, 10E, 10F, 10G, 10H, 10I, and 10J are cross-sectional views of illustrative coupling structures that may be used in an electronic device to couple the electronic device to an extendable, removable antenna in accordance with an embodiment of the present invention.
Figure 10B:
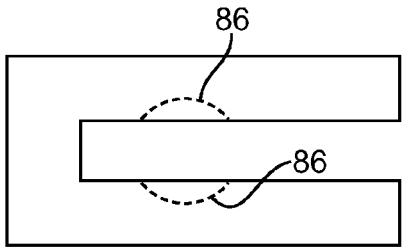
Figure 10C:
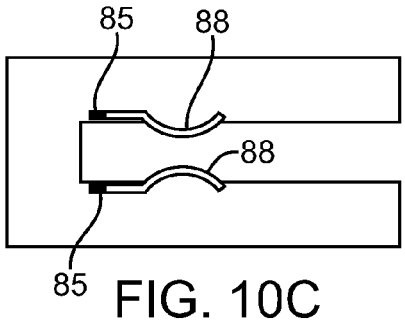
Figure 10D:
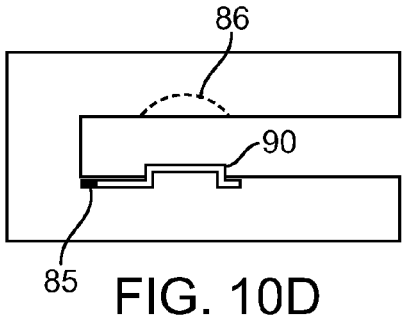
Figure 10E:
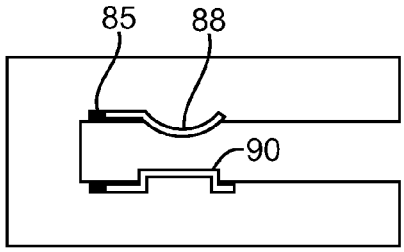

Coupling structure 88, as illustrated in FIGS. 10A, 10C, and 10E, may be a suitably shaped flexure. For example, coupling structure 88 may be formed in a spherical shape with an elastic material. Coupling structure 88 may couple with a corresponding coupling structure in antenna structure 26 such as a circular hole or a spherical depression (e.g., such as coupling structure 54 of FIG. 4). Coupling structure 88 may be secured to device 10 at location 85 and may be able to flex into or against device 10. For example, a force applied against coupling structure 88 may press the coupling structure into or flat against device 10 (e.g., so that antenna structure 26 may be removed from device 10). Coupling structure 88 may be similar to coupling structure 74.

Coupling structure 90 may be a rectangular flexure. Coupling structure 90 may be formed in a rectangular shape with an elastic material. In another example, coupling structure 90 may be formed in any suitable shape such as a pentagon, hexagon, etc. Coupling structure 90 may couple with a corresponding coupling structure in antenna structure 26 such as a rectangular hole or depression. When coupling structure 90 is formed in a shape such as a pentagon, hexagon, etc., the corresponding coupling structure in the antenna structure may be a hole or depression with the appropriate shape. Coupling structure 90 may be secured to device 10 at location 85 and may be able to flex into or against device 10. For example, a force applied to coupling structure 90 may press the coupling structure into or flat against device 10.

Coupling structure 86, as illustrated in FIGS. 10A, 10B, and 10D, may be a spherical depression in device 10. Coupling structure 86 may be configured to couple with a corresponding coupling structure in antenna structure 26 that may be similar to coupling structures 74 or 88.

Figure 10F:
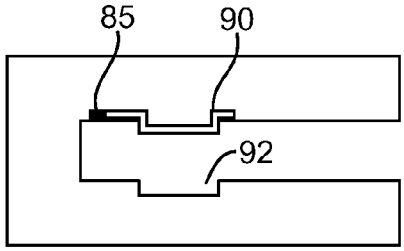
Figure 10G:
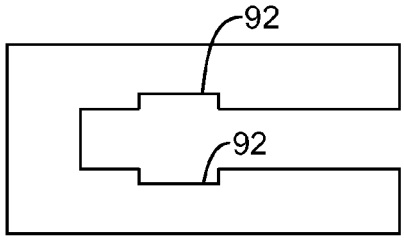
Figure 10H:
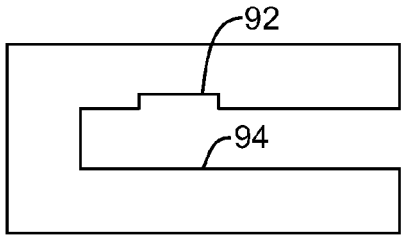

Illustrated by FIGS. 10F, 10G, and 10H, coupling structure 92 may be a rectangular depression in device 10. Coupling structure 92 may couple with a corresponding coupling structure in antenna structure 26 such as a coupling structure similar to coupling structure 80 or 90.

As illustrated by FIG. 10H, device 10 may be configured with a single coupling structure (e.g., structure 92) and with no coupling structure on the opposing side (e.g., side 94).

Figure 10I:
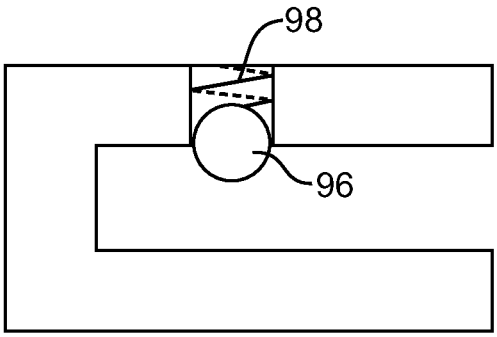
Figure 10J:
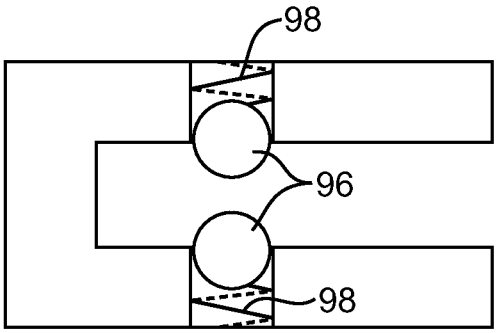

A ball biased by a spring or other biasing member may be used as a coupling structure in an electronic device. As shown in FIG. 10I, ball 96 may be biased by spring 98 and may be used to physically and electrically couple device 10 to antenna structure 26. Ball 96 and/or spring 98 may be electrically conductive or may be coated with an electrically conductive coating. Ball 96 may be biased by spring 98 into a corresponding coupling structure in antenna structure 26 when the antenna structure is coupled with device 10. For example, ball 96 may be biased into a spherical depression in coupling structure 54 of the antenna structure such as the depression in coupling structure 76.

In one embodiment, device 10 may be configured with two balls 96 that are biased by springs 98. The two balls may be biased into two corresponding coupling structures (e.g., structures 76 of FIG. 9C) when antenna structure 26 is coupled with device 10.

The coupling structures of FIGS. 5A, 5B, 6A, 6B, 7A, 7B, 8A-8C, 9A-9J, and 10A-10J are merely illustrative examples of coupling structures that may be used in antenna structure 26 and device 10. Any suitable combination of the various coupling structures described in connection with FIGS. 5A, 5B, 6A, 6B, 7A, 7B, 8A-8C, 9A-9J, and 10A-10J may be used in antenna structure 26 and/or device 10. Coupling structures that have been described as being in the antenna structure or in device 10 (e.g., as part of coupling structure 52 or 54 of FIG. 4) may be swapped between the antenna structure and the device without sacrificing the functionality of the coupling structures.

Figure 11A:
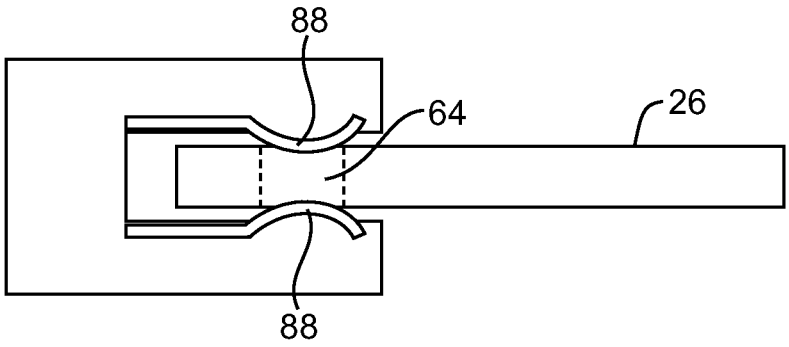
FIG. 11A is a cross-sectional view of an illustrative antenna coupling structure in an electronic device and an illustrative extendable, removable antenna in a coupled state in accordance with an embodiment of the present invention.
Figure 11B:
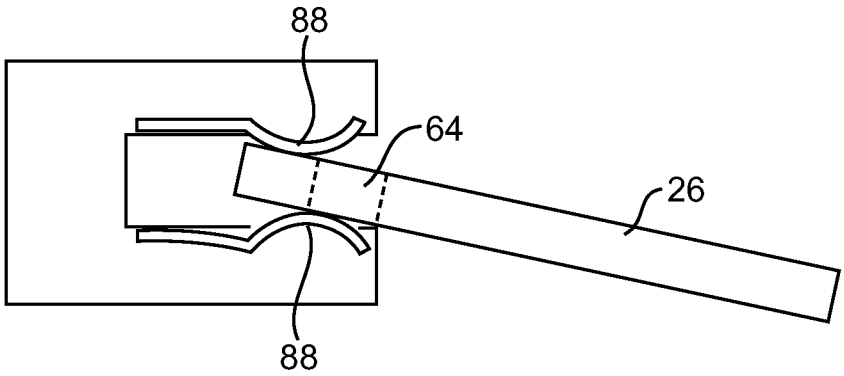
FIG. 11B is a cross-sectional view of the illustrative antenna coupling structure and the illustrative extendable, removable antenna of FIG. 11A in a partially coupled state in accordance with an embodiment of the present invention.
Figure 11C:
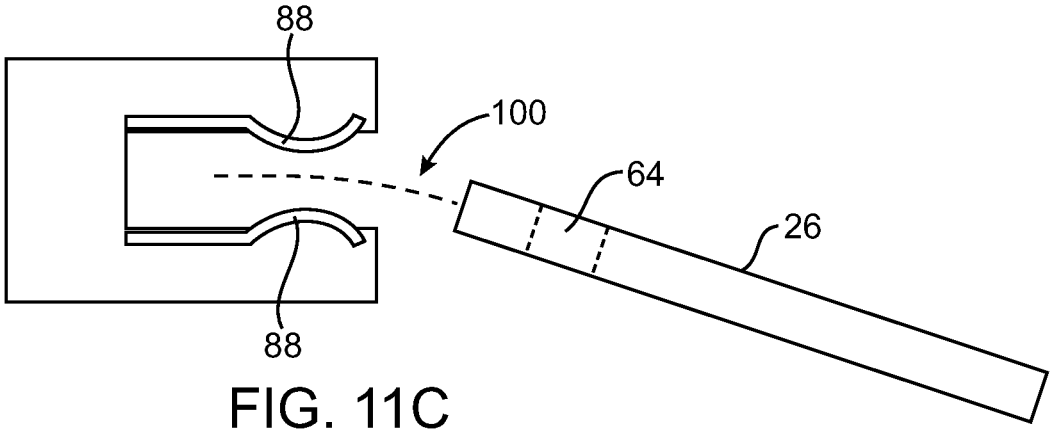
FIG. 11C is a cross-sectional view of the illustrative antenna coupling structure and the illustrative extendable, removable antenna of FIG. 11A in an uncoupled state in accordance with an embodiment of the present invention.

FIGS. 11A, 11B, and 11C show three stages of coupling of an antenna structure with device 10. FIG. 11A illustrates antenna structure 26 in a coupled position with device 10. When the coupling structures of antenna structure 26 and device 10 are in the coupled position, the antenna structure and the device are both physically and electrically coupled together. The coupling structures of antenna structure 26 and device 10 are illustrated as coupling structures 88 and 64, respectively. However, any suitable coupling structures may be used in the antenna structure and the device.

As shown in FIG. 11B, the antenna structure may be removed from device 10. As the antenna structure is removed from device 10, the coupling structures of the antenna structure and the device may flex to allow the antenna structure to be removed. For example, the coupling structures of device 10 (e.g., structures 88) may be deformed by the antenna structure as it is removed or inserted into device 10.

As shown in FIG. 11C, when the antenna structure is completely decoupled from device 10, the coupling structures of device 10 and antenna structure 26 may elastically return to their natural positions. For example, coupling structures 88 of device 10 may elastically return to the position shown in FIG. 11C. As illustrated by dotted line 100, antenna structure 26 may be coupled with or decoupled from device 10.

Figure 12:
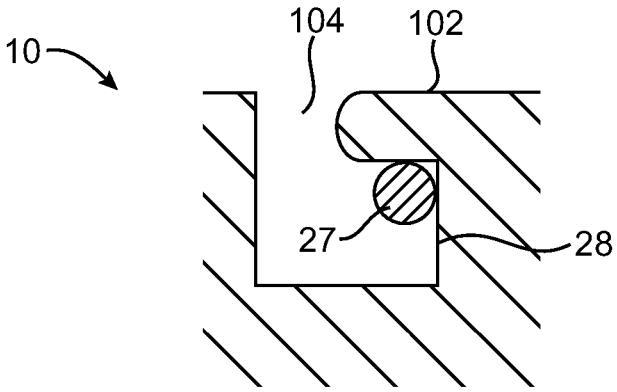
FIG. 12 is a cross-sectional view of an illustrative antenna receptacle in an electronic device and an illustrative resilient antenna in a stowed state in accordance with an embodiment of the present invention.
Figure 13:
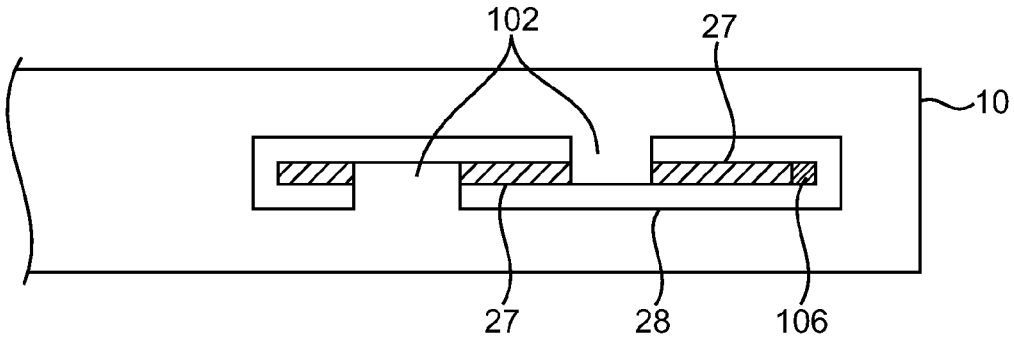
FIG. 13 is a top view of an illustrative antenna receptacle in an electronic device and an illustrative resilient antenna in a stowed state in accordance with an embodiment of the present invention.

As illustrated by FIGS. 12 and 13, the resilient antenna of FIG. 2 (e.g., antenna structure 27) may be bent and secured into an antenna receptacle such as antenna receptacle 28 in device 10. Antenna receptacle 28 may be a trough or a long, narrow, and shallow receptacle that is configured to hold resilient antenna structure 27 in a stowed position. For example, antenna receptacle 28 may be a trough with one or more tabs 102 that hold the antenna structure in its stowed position. Any suitable number of tabs may be used. The tabs may restrain the antenna structure within the trough of the antenna receptacle. The tabs may be spaced at least far enough apart that the resilient antenna may elastically flex or bend around the tabs when the resilient antenna is removed from the antenna receptacle. The antenna structure may include a flexible antenna resonating element formed from an elastic wire or other such structure. When a user desires to extend the antenna structure, the user may elastically flex or bend the resilient antenna structure around tabs 102 and the antenna structure may be removed through openings in the antenna receptacle such as openings 104. The user may then extend the antenna structure by elastically flexing or bending the antenna structure to its extended position. With one suitable arrangement, the antenna structure may elastically return to its extended position when no stresses are applied (e.g., when the user is not bending the antenna into the antenna receptacle, or when the tabs are holding the antenna in the antenna receptacle). Antenna structure 27 may be electrically coupled to circuitry 18 (e.g., a radio-frequency transceiver) in device 10 through communications path at coupling point 106.

The foregoing is merely illustrative of the principles of this invention and various modifications can be made by those skilled in the art without departing from the scope and spirit of the invention.

What is claimed is:

1. Apparatus comprising:

an electronic device having an antenna receptacle; and a resilient antenna formed from a conductive elastic material, wherein the resilient antenna elastically flexes between a stowed position in the antenna receptacle and an extended position outside of the antenna receptacle and wherein the antenna receptacle comprises portions defining a trough and at least one tab that at least partially extends across the trough.

2. The apparatus defined in claim 1 wherein the resilient antenna is configured to flex into the trough and wherein the tab is configured to restrain the resilient antenna within the trough.

3. The apparatus defined in claim 1 wherein the at least one tab comprises at least two tabs, each of which at least partially extends across the trough.

4. The apparatus defined in claim 3 wherein the resilient antenna is configured to flex into the trough and wherein the tabs are configured to restrain the resilient antenna within the trough.

5. The apparatus defined in claim 1 wherein the resilient antenna has a width, wherein the trough has a width, wherein the tab has a width that extends partly across the trough, and wherein the width of the resilient antenna plus the width of the tab is less than the width of the trough.

6. An electronic device comprising:

an antenna receptacle;

an antenna, wherein the antenna flexes between a stowed position in the antenna receptacle and an extended position outside of the antenna receptacle;

a radio-frequency transceiver; and a communications path that conveys radio-frequency signals between the radio-frequency transceiver and the antenna, wherein the antenna receptacle has portions defining a trough and at least one tab that at least partially extends across the trough, wherein the antenna has a width, wherein the trough has a width, wherein the tab has a width that extends partly across the trough, and wherein the width of the antenna plus the width of the tab is less than the width of the trough.

7. An electronic device comprising:

an antenna receptacle;

an antenna, wherein the antenna flexes between a stowed position in the antenna receptacle and an extended position outside of the antenna receptacle;

a radio-frequency transceiver; and a communications path that conveys radio-frequency signals between the radio-frequency transceiver and the antenna, wherein the antenna receptacle has portions defining a trough and at least a first tab and a second tab, each of which at least partially extends across the trough, wherein the trough has a first side and a second side opposite the first side, wherein the first tab is connected to the first side of the trough, and wherein the second tab is connected to the second side of the trough.

8. An electronic device comprising:

an antenna receptacle; and an antenna configured to flex between a stowed position within the antenna receptacle and an extended position, wherein the antenna receptacle comprises a trough and at least one tab that extends across the trough and wherein, when the antenna is in the stowed position, the antenna is within the trough.

9. The electronic device defined in claim 8 wherein, when the antenna is in the stowed position, the at least one tab bears against the antenna and restrains the antenna in the trough.

10. The electronic device defined in claim 8 wherein the at least one tab comprises first and second tabs on opposing sides of the trough, wherein the first and second tabs each extend partly across the trough, and wherein, when the antenna is in the stowed position, the first and second tabs bear against the antenna and restrain the antenna in the trough.

11. The electronic device defined in claim 8 wherein the antenna comprises an elastic wire.

* * * * *